United States Patent [19]

Poppendieck

[11] 4,454,622

[45] Jun. 19, 1984

[54] FINGERNAIL POLISH BRUSH

[76] Inventor: Donna L. Poppendieck, Paul-Lagarde-Str. 22, D-8000 Munich 21, Fed. Rep. of Germany

[21] Appl. No.: 249,737

[22] Filed: Mar. 31, 1981

[51] Int. Cl.[3] ..... A46B 9/02

[52] U.S. Cl. ..... 15/167 B; 15/DIG. 5; 15/160; 401/129

[58] Field of Search ..... 15/DIG. 5, 160, 167 B, 15/225; 401/129; 132/73, 74.5

[56] References Cited

U.S. PATENT DOCUMENTS

| | | | |
|---|---|---|---|
| D. 119,914 | 4/1940 | Florman | 15/160 X |
| 1,146,522 | 7/1915 | Robert | 15/160 X |
| 1,966,581 | 7/1934 | Conner | 401/129 X |
| 2,096,975 | 10/1937 | Revson | 401/129 X |
| 2,104,196 | 1/1938 | Harmon | 300/21 |
| 2,283,123 | 5/1942 | Osborne | 401/129 |
| 2,917,766 | 12/1959 | Ciffo | 401/129 X |

FOREIGN PATENT DOCUMENTS

| | | | |
|---|---|---|---|
| 528920 | 7/1931 | Fed. Rep. of Germany | 15/28 |
| 890205 | 11/1943 | France | 132/73 |
| 471782 | 9/1937 | United Kingdom | 401/129 |

*Primary Examiner*—Peter Feldman

[57] ABSTRACT

This invention concerns a nail polish brush so constructed as to provide more even and exact stroking, especially onto the top of the fingernail, where the cuticle is rounded. The hairs on the perimeter of the brush are shortest in length, the next circle of hairs lying inside the outer circle of hairs are slightly longer, each successive circle of hairs increasing in length this way, and the last round of hairs in the center of the brush are the longest. The entire effect is one of very slight, gradual rounding, corresponding more exactly to the human cuticle.

1 Claim, 6 Drawing Figures

Fig. 1
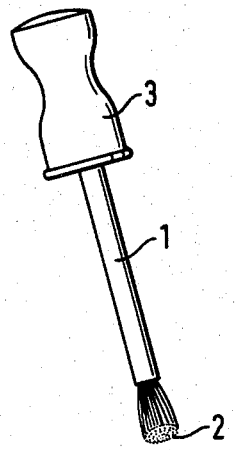
Fig. 2
Fig. 2a
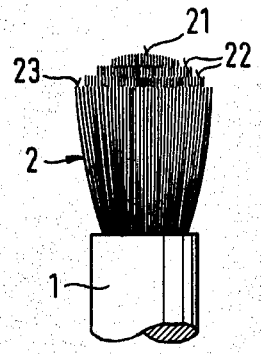
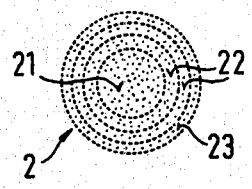
Fig. 2b
Fig. 3
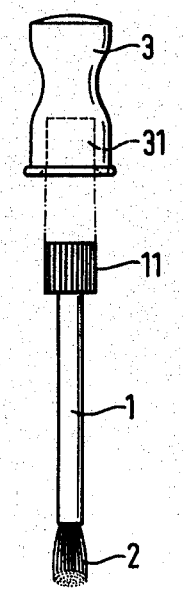
Fig. 4
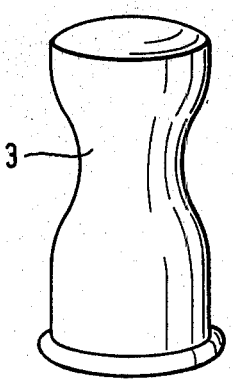

FINGERNAIL POLISH BRUSH

The invention concerns a nail polish brush with a rounded brush tip.

Such a nail polish brush is known from, for example, GB-PS No. 10 83 891. With this known nail polish brush, the brush hairs form a flat, curved band with rounded tip corresponding to the curvature of the human nail. It has become evident that this form of brush tip is not optimal, because with the one sided curvature of the brush tip, one can only polish with one side of the brush hairs, and consequently, the polish on the upper side of the brush tip begins to dry, causing the brush hairs to become hard. A regular nail polish application is then no longer possible.

The purpose of the present invention is to form a nail polish brush assuring an even polish application and, in particular, assuring that all the polish absorbed by the brush tip from the nail polish bottle can be applied onto the nail surface.

To accomplish this task, according to the invention, it is proposed to arrange the brush hairs into concentric rings, the lengths of which increase gradually from one ring to the next, towards the middle.

According to the invention, the construction of the nail polish brush achieves a constantly curved brush tip, whereby, through the rotationally symmetric arrangement of the brush hairs, the same curvature of the brush is maintained independent of the angle. Thus, all the polish applied from the brush tip will be used by turning the nail polish brush about its longitudinal axis, without the brush tip taking on a different shape.

With the preferred shape of the invention, i.e., the decrease of the lengths of the brush hairs, the curvature of the brush tip corresponds to the curvature of the human cuticle. Through this shape, the entire surface of the nail up to its edge can be polished; as opposed in particular to brushes with flat or pointed tips.

Further, according to the invention, the brush stem should be held in a rotationally formed cap. When applying the polish, the turning of the brush between the fingers is hereby facilitated.

Finally, it is advantageous if the holding cap of the brush stem is splined onto the cap so that they may be easily separated, since then for example brushes with different shapes can be put into this holding cap.

The enclosed drawings will illustrate the execution of the invention. In these drawings, the following is shown:

FIG. 1 is a sideview of the fingernail polish brush of the present invention;

FIG. 2 shows a side view and a top view, represented by FIG. 2*a* and FIG. 2*b*, respectively, of an enlarged brush tuft of FIG. 1;

FIG. 3 is a side view of the fingernail polish brush of FIG. 1, showing the brush stem separate from its holding cap; and , FIG. 4 is an enlarged perspective view of the holding cap.

The nail polish brush represented by FIG. 1 shows as fixation rotationally formed cap 3. From cap 3, the brush stem 1, preferably in the form of a tube, extends downward. The brush hairs 2 are located at the front end of the brush stem 1. The arrangement of the brush hairs 2 is shown from FIG. 2. The side and top views show that the brush hairs 2 are arranged in the form of concentric rings, whereby the external ring has the reference number 23, while the concentric rings towards the middle have the number 22, and the batch of hairs in the center of the brush tip has the number 21. The brush hairs in each concentric ring are of the same length, as shown in FIGS. 2*a* and 2*b*. The length of the brush hairs increases gradually from one ring to the next towards the middle where the center portion forms a dome-shaped contour, which is to be recognized from the side view according to FIG. 2*a*. Thereby the increase of the lengths of the hairs is achieved through a smooth and regularly curved brush tip, the curvature of which corresponds approximately to the human cuticle.

The illustration according to FIG. 3 shows that the brush stem 1 with the brush hairs 2 can be separated from the cap 3. The brush stem 1 has a widened cylindrical splined shaft 11 which fits into a corresponding housing 31 of the cap 3 where it is fastened preferably with a spring arrangement. According to FIG. 4 the diagonal view of the cap 3 shows the rotational-symmetrical execution of this cap 3.

I claim:

1. A fingernail polish brush used for the application of fingernail polish onto a fingernail comprising a rotationally symmetrical tuft of hairs secured to the front end of a brush stem, said tuft of hairs being arranged in the form of a plurality of concentric rings, the hairs in each ring having the same length, the length of each ring increasing gradually from one ring to the next from the outer perimeter of the tuft toward the center thereof where the center portion forms a dome-shaped contour, the overall contour of the brush tuft from the outer perimeter to the center forming a constantly curved gradually rounding brush tip corresponding approximately to the curvature of the human cuticle, whereby, through the rotationally symmetric arrangement of the brush hairs, the same curvature is maintained independent of the angle of rotation, and characterized in that all the polish absorbed by the brush tip from the nail polish bottle can be utilized by turning the brush about its longitudinal axis, without the brush tip taking on a different contour, whereby the entire surface of the fingernail up to its edge can be polished.

* * * * *